United States Patent [19]

Miller

[11] Patent Number: 4,987,036

[45] Date of Patent: Jan. 22, 1991

[54] MARINE ANTIFOULING

[75] Inventor: Keith E. J. Miller, Maidenhead, United Kingdom

[73] Assignee: Seamark Systems Limited, Edinburgh, Scotland

[21] Appl. No.: 460,193

[22] PCT Filed: Jun. 2, 1989

[86] PCT No.: PCT/GB89/00610

§ 371 Date: Feb. 12, 1990

§ 102(e) Date: Feb. 12, 1990

[87] PCT Pub. No.: WO89/12144

PCT Pub. Date: Dec. 14, 1989

[30] Foreign Application Priority Data

Jun. 2, 1988 [GB] United Kingdom ..... 8813036

[51] Int. Cl.[5] ..... B32B 15/08; B32B 31/26

[52] U.S. Cl. ..... 428/626; 428/462; 114/222; 156/71; 156/86

[58] Field of Search ..... 114/222, 67 R, 270; 428/608, 675, 457, 462, 626, 624; 156/71, 84, 86, 185, 165, 187

[56] References Cited

U.S. PATENT DOCUMENTS

| | | | |
|---|---|---|---|
| 3,497,990 | 3/1970 | Jeffries | 114/222 |
| 3,505,758 | 4/1970 | Willisford | 114/222 |
| 3,761,334 | 9/1973 | Zondek | 114/222 |
| 4,082,588 | 4/1978 | Anderton et al. | 114/222 |
| 4,375,199 | 3/1983 | Graeme-Barber et al. | 114/67 R |
| 4,603,653 | 8/1986 | Bews | 114/222 |

FOREIGN PATENT DOCUMENTS

| | | | |
|---|---|---|---|
| 0145802 | 6/1985 | European Pat. Off. . | |
| 2411620 | 9/1975 | Fed. Rep. of Germany . | |
| 57-11194 | 1/1982 | Japan | 114/222 |
| 57-26084 | 2/1982 | Japan | 114/222 |
| 57-26085 | 2/1982 | Japan | 114/222 |
| 57-37091 | 3/1982 | Japan | 114/222 |
| 57-130891 | 8/1982 | Japan | 114/222 |
| 58-26695 | 2/1983 | Japan | 114/222 |
| 58-183381 | 10/1983 | Japan | 114/270 |
| 59-9181 | 1/1984 | Japan | 114/222 |
| 59-156893 | 9/1984 | Japan | 114/222 |
| 60-152683 | 8/1985 | Japan | 114/222 |
| 1-212692 | 8/1989 | Japan | 114/222 |
| 2148803A | 6/1985 | United Kingdom | 114/270 |

*Primary Examiner*—John J. Zimmerman

*Attorney, Agent, or Firm*—Watson, Cole, Grindle & Watson

[57] ABSTRACT

A substantially continuous copper-containing antifouling surface is formed on a marine structure by attaching thereto a composite comprising a plurality of strips of copper (or copper alloy) mounted side-by-side on a support. The composite may be adhered to the structure or it may, for example, be applied to an uncured neoprene coating on the structure which is subsequently cured.

9 Claims, 5 Drawing Sheets

MARINE ANTIFOULING

BACKGROUND OF THE INVENTION

This invention is concerned with marine antifouling and, more particularly, with a composite material useful for cladding marine structures to provide resistance against marine fouling.

It has been known for many years that metallic copper and copper-nickel alloys have antifouling properties. However, it has often proved difficult in practice to provide copper or copper-alloy surfaces on marine structures in a manner and form such as to obtain the benefit of the antifouling properties. One problem is that, on steel marine structures, the copper must be kept out of direct electrical contact with the steel since otherwise the antifouling effect is lost. This has not always been easy to achieve reliably.

Very often, it is desired not only to confer antifouling properties on a marine structure, but also to physically protect it against corrosion. It has been found that synthetic materials such as polychloroprenes (e.g.), neoprene) and the like provide very effective protective coatings on structural members in a marine environment. Conventionally, neoprene coatings are applied to offshore structures at a factory or similar facility prior to immersion. The structural elements (e.g. tubular members); to be coated are shot blasted to a high standard of surface finish and coated with a bonding agent to assist adhesion of the neoprene to the steel substrate. They are then deployed onto a horizontal lathe which rotates the tubular member. A dispensing station moves axially along the tubular member such that the (uncured) neoprene is helically wrapped around the pipe to form a total surface coating. When only an anti-corrosion coat is required, this neoprene layer is further wrapped in a nylon or similar outer taped layer and the composite placed inside a pressure vessel and vulcanised using pressure and steam heat. The vulcanisation process cures the neoprene, which forms a very strong bond with the steel substrate and is very durable in seawater. A similar result can be achieved by using a hand lay-up technique with calendared sheets of uncured neoprene and localised heating and curing techniques.

An extension of this method has been developed to provide an antifouling coating by placing a sheet of copper or copper-nickel alloy around the uncured neoprene after suitable surface preparation and use of bonding agents. The nylon tape wrap is applied over the outer side of the sheet, and the assembly is vulcanised in the normal manner. The sheet of copper or copper-nickel is generally preformed by rolling to conform to the curvature of the tubular member prior to installation and has to be cut precisely to size: both of these preparatory processes are time consuming and labour-intensive.

Attempts to simplify this process by using a continuous length of copper or copper-nickel alloy which is wound on to the tubular member as a continuous helix are described in European specification no. 0188357A. However, in practice a number of problems arise which make this process unsatisfactory. In particular, there are varying thermal expansion and contraction rates for the copper and steel components, and the neoprene itself contracts upon cure, so that intermittent buckling of the helically wound copper surface tends to occur, with local loss of fouling protection and a puckered finish.

SUMMARY OF THE INVENTION

We have now found that this problem can be overcome by using an antifouling material which, rather than being a continuous length of copper, is instead made up of a plurality of relatively small copper (or copper alloy) strips or platelets laid side-by-side so that volumetric changes can be accommodated by small relative movements of adjacent strips without any buckling occurring.

According to the present invention, there is provided a composite marine antifouling material for application to marine structures to provide an antifouling surface thereon, which composite comprises copper or copper-nickel alloy to form the surface, and a substrate; characterised in that the copper or copper-nickel alloy is in the form of a plurality of strips mounted side-by-side on the substrate which is a support for the strips, and wherein when the composite is applied to the surface of a marine structure, the strips provide a substantially continuous copper or copper alloy surface thereon.

The invention also includes a method of providing a substantially continuous copper-containing marine antifouling surface on a marine structure, which comprises applying to the structure a composite of the invention.

In the composites of the invention, the individual copper (or copper alloy) strips or platelets are held together by a support. The support may for example be a grid or mesh, covering substantially the complete area of the copper surface, or it may be one or more support strips running at right angles, for example, to the major axis of the copper strips. The backing or support material can be either non-metallic, e.g., a polyester or similar plastic mesh or grid, or metallic, e.g., compatible copper. The support structure is preferably generally of open construction to allow the securing medium to have direct access to a high proportion of the underside of the copper surface elements, thus enabling direct adhesion between the securing medium and the copper surface elements in use of the composite.

The support is normally on the underside of the copper strips, i.e., so that in use the support is sandwiched between the copper and the underlying marine structure. However, it is also possible to use temporary supports, e.g., polyester tape or the like, applied to the top surfaces of copper strips. The temporary supports may then be removed after the composite has been bonded to the marine structure. An advantage of this procedure is that the whole of the underside surface of the copper strips is available for bonding to the neoprene or underlying structure as required.

The strips or platelets of copper used in the composites of the invention are laid substantially parallel, face-up, and held together by the support. The size and shape of the strips are not eespecially critical but will usually be selected with the intended use of the composite in mind. Usually, the strips will be of substantially parallelogram shape, e.g. rectangular, and of a width of from about 10 to 70 mm and a thickness of 0.5 to 1.5 mm. Other shapes and sizes can be used. The length of each strip may vary widely but will normally be in the range of about 70 mm to 300 mm.

A most important (but not the only) use of the composites of the invention is in providing antifouling surfaces on tubular marine members. In such cases, the composites will usually be applied in one of two main ways. Firstly, a blanket of composite can be wrapped around a length of tubular member, to provide a longitudinal butt joint. Thus, for example, the "blanket" may comprise an array of copper strips on a support, the width of the blanket being equal to the circumference of the tubular member around which it is to be wrapped, and the length of the blanket equalling the length of the tubular member desired to be covered. The individual copper strips will normally lie lengthwise of the blanket and overall a blanket measuring about 1 m width by 3 m length might comprise a regular array of about 20 by 20 rectangular copper (or copper alloy) strips or platelets.

Alternatively, and more usually, a length of composite will be helically wound around the tubular member. In both cases, it is a preferred feature of the invention that the major axes of the copper strips lie parallel to the longitudinal axis of the tubular member. In the case of helical winding, this means that the longitudinal axes of the individual copper strips will lie at an angle to the longitudinal extent of the length of composite, the angle being substantially the same as the intended helical winding angle.

The composites of the invention can be used to advantage in a number of ways. They are especially useful for application over a neoprene (or the like) uncured protective coating, because they can overcome the problems experienced in the prior art due to thermal and volumetric contractions occurring in the vulcanisation process. Generally, the composite can be made sufficiently flexible and compliant to be applied directly around the neoprene. Thus, the composite is incorporated into the vulcanisation process either by spiral wrapping around the uncured neoprene or by single sheets or "blankets" wrapped in "cigarette paper" fashion. Nylon tape is wound around the combined components and the whole assembly is vulcanised in the normal way. The composite material to be used in this way and incorporating a metallic support structure, has a small gap, circa 1 mm., between each copper element so that, on curing, the volumetric contraction allows each element to butt closely to its neighbours without any substantial surface distortion to form a virtual continuum of copper. A similar result can be achieved with or without providing a gap between adjacent elements, by bevelling or otherwise appropriately shaping the edges of each copper strip so that, on curing, the adjacent strip elements can slide with respect to their neighbours to produce the continuum copper as with the previous option.

When the composite comprises a non-metallic support, the support preferably has sufficient elasticity for gaps to be created in the composite surface by tensioning when the composite is wrapped onto the surface of the uncured neoprene. These gaps would also close up during the curing operation as with the metallic support structure described above.

A second preferred use of the composite is to provide antifouling properties on an otherwise unclad marine structural member of, for example, steel. In this case, the composite may be adhesively bonded, for example, to the marine structure. A range of possible adhesives is available and these generally are applied to the tubular structure as a thin film, typically 0.5 to 2 mm, after shotblasting and priming of the surface of the structure. The antifouling composite is then held in position in contact with the adhesive film and the adhesive allowed to cure. The support will then act as a spacer or standoff which, when a non-metallic material is chosen, will ensure that no electrical contact exists between the copper surface elements which would "switch off" the antifouling performance.

Some adhesive systems have incorporated within the mix a graded inert filler element, circa 1 mm, which acts as a stand-off. When adhesives of the type are used in conjunction with the composite material there is no longer any need to differentiate between the non-metallic and metallic versions as the filler ensures that no "switch off" occurs.

It will be appreciated that a very important feature of the present invention is the use of a plurality of copper plates or strips instead of a large single sheet or ribbon, so that variations (especially but not exclusively the contractions during vulcanisation) can be absorbed without any significant deformation of the overall copper surface. The copper strips are designed to lie together in the clad structure to provide a substantially continuous antifouling surface.

In order that the invention may be more fully understood, various embodiments thereof will now be described, by way of illustration only, with reference to the accompanying drawings, to.

BRIEF DESCRIPTION OF THE DRAWINGS

In the drawings, like numerals indicate like parts.

DETAILED DESCRIPTION OF THE PREFERRED EMBODIMENTS

Figure 1:
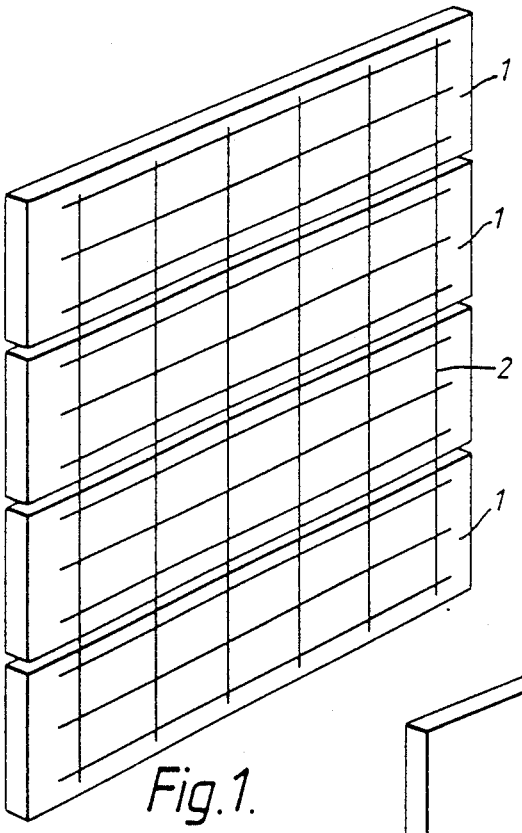
FIG. 1 is a perspective view of the reverse side of a first composite of the invention.
Figure 2:
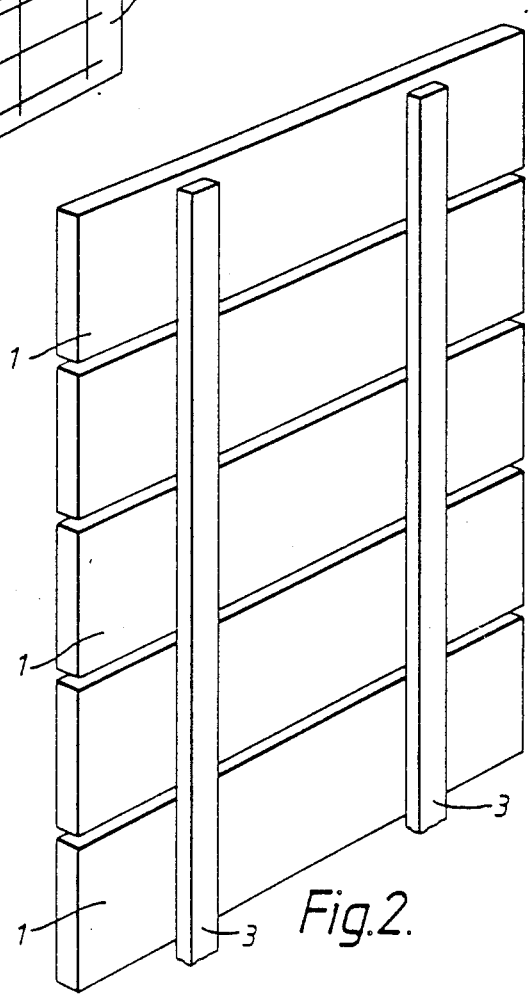
FIG. 2 is a perspective view of the reverse side of a second composite of the invention.
Figure 3A:
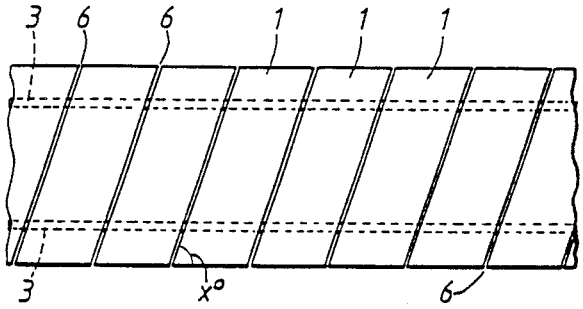
FIG. 3A is a schematic top plan view of a length of composite especially for helical winding on a tubular marine member.
Figure 3B:
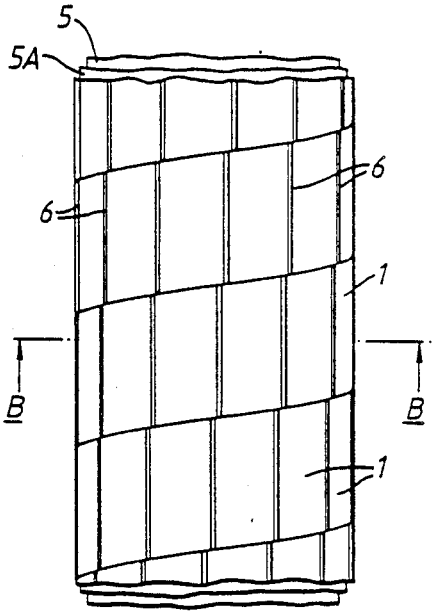
FIG. 3B is a tubular schematic elevation of a marine member wound with the composite of FIG. 3A before vulcanisation.
Figure 4A:
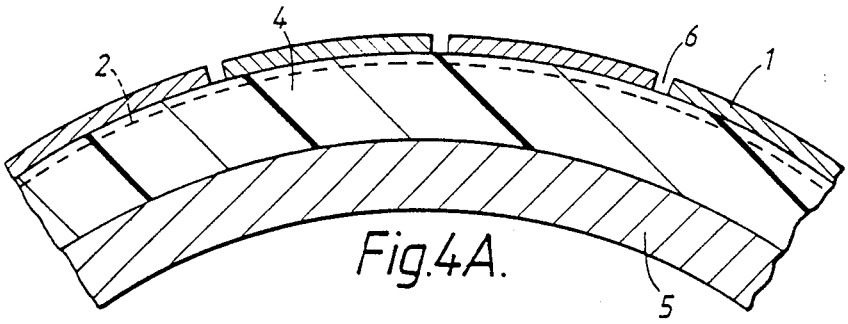
FIG. 4A is a part section on the line B—B of FIG. 3A.
Figure 4B:
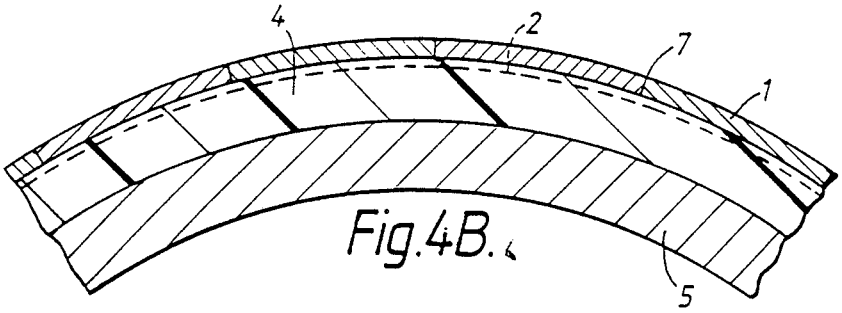
FIG. 4B is a part section similar to FIG. 3B but after vulcanisation.

Referring to FIG. 1, there is shown a composite of the invention comprising a plurality (only four are shown) of copper strips 1, each joined to a mesh or grid support 2. The support 2 holds the copper strips in generally parallel relationship and slightly spaced apart. In FIG. 2, the arrangement is generally similar except that the support is not a grid or mesh, but rather two spaced bars 3. In FIG. 2, five strips 1 are illustrated, but in both FIGS. 1 and 2, the composite could be much longer, e.g. 20, or 40 or more copper strips arranged as illustrated in "ladder form". FIGS. 3 and 4 illustrate the invention in relation to helical winding on a tubular marine member. Referring firstly to FIG. 3A, there is shown part of a length of composite of the invention consisting of a plurality of copper or copper alloy strips (or platelets) 1, lying side-by-side on a pair of elongate support bars 3. Instead of the illustrated bars 3 there could equally be a grid or net as shown in FIG. 1. In this embodiment, the individual copper strips are not exactly rectangular but are parallelograms of angle x equal to about 75° to 83°. The purpose of this is to ensure that, as the composite is wound around the tubular marine member (FIG. 3B), the resulting orientation of the copper strips will be parallel to the axis of the tubular member. The helical winding angle will normally be between about 7° and 15°, and thus the composite is made at the appropriate angle x in relation to the intended eventual winding angle. It is a highly preferred, but not essential, feature of the invention to have the copper strips 1 extending parallel to the axis of the tubular member. In this way, the strips conform better and more easily to the curvature of the underlying tubular member.

It will be noted in FIGS. 3A and 3B that there are tiny gaps 6 between the edges of adjacent strips 1. In the alternative, an elastic support could be used instead of bars 3, in which case substantially no gaps 6 would be apparent in FIG. 3A. However, the gaps 6 would (in this embodiment of the invention) be seen in FIG. 3B because the helical winding would be carried out under tension to deliberately create gaps 6 between the strips 1. The composite is being applied to a tubular member 5 which has been pre-coated with neoprene 5A in a conventional way. After helical winding of the composite over the neoprene, the coated tubular member is heated to cure the neoprene, whereupon shrinkage of the neoprene coating occurs. The composite takes up the shrinkage by closure of the gaps 6, so that in the finished article, there is a substantially continuous copper surface.

As will be understood, tubular marine members can vary in diameter. Generally, helical winding of the larger tubular members is carried out at a lower angle than is winding of the smaller tubular members. However, another factor is tape width (i.e., the width of the length of composite) and this will be varied depending on requirements.

Figure 5:
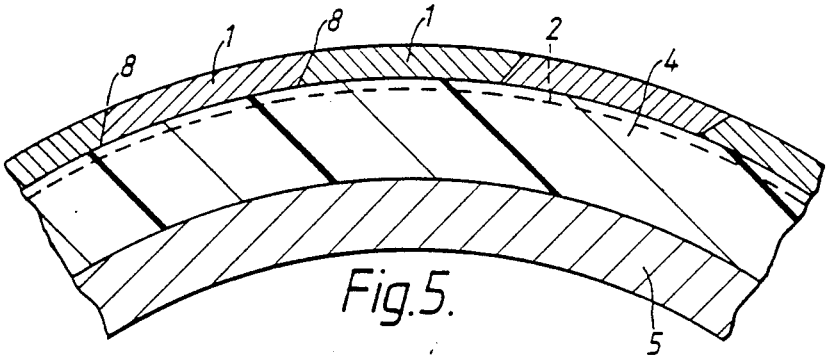
FIG. 5 is a part section, similar to FIG. 3A, but of a different composite before vulcanisation.
Figure 6:
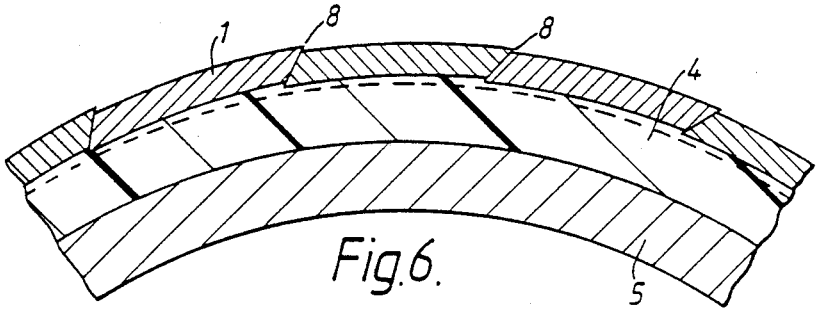
FIG. 6 is a part section as in FIG. 5 but after vulcanisation.

FIGS. 5 and 6 illustrate the use of a slightly different composite from that of FIG. 1 or 2. In the composite used in FIGS. 5 and 6, the copper strips 1 are in abutment. However, their contiguous side edges 8 are bevelled. FIG. 5 shows the arrangement before vulcanising. The tubular member 5 has a layer 4 of uncured neoprene thereon, and the support 2 for the copper strips is embedded in the neoprene. Upon vulcanisation, the neoprene shrinks and the copper strips slide relative to each other at their bevelled edges 8, as illustrated, to accommodate the shrinkage and maintain a continuous unbuckled copper surface.

Figure 7A:
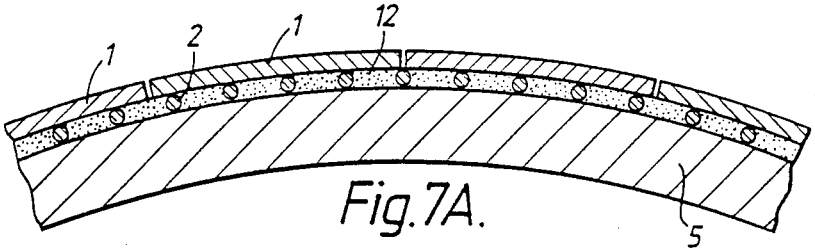
FIG. 7A is a part section of a tubular marine with a composite of the invention thereon.

FIG. 7A illustrates the application of a composite of the invention directly on to a marine structural member, e.g. a tubular member 5. The composite is basically as shown in FIG. 1, viz. a plurality of copper strips 1 on a grid support 2. The steel tubular 5 has been shotblasted and primed, and an adhesive film 12 applied. The composite is placed on film 12 so that the adhesive penetrates the grid 2 and adheres directly to the copper strips 1. It will be seen that grid 2 acts as a standoff to prevent the copper strips 1 contacting the tubular member 5. Also, because the composite has flexibility (much more, for example, than a sheet of copper of the same thickness), it can ride over and absorb any surface irregularities in the tubular.

Figure 7B:
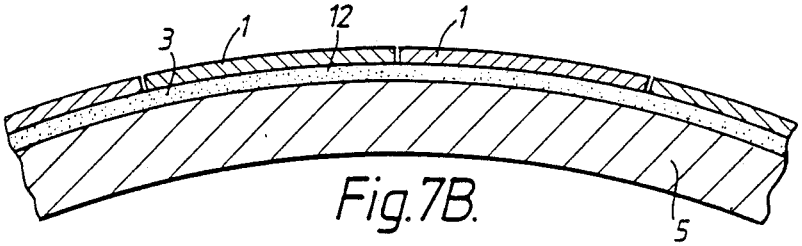
FIG. 7B is similar to FIG. 7A but showing a different composite.

FIG. 7B is essentially similar to FIG. 7A except that here the composite is as in FIG. 1B.

Figure 8:
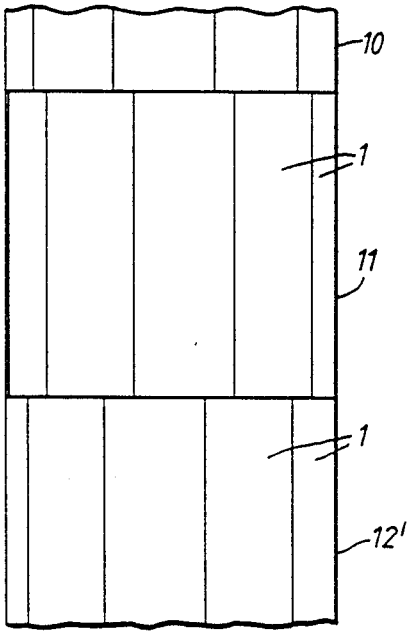
FIG. 8 is an elevation cf a tubular member clad with a composite of the invention.

FIG. 8 illustrates a tubular marine member with a series (three shown) of "collars" 10,11,12, each formed by wrapping a composite of the invention around the tubular member. Collar 11 comprises the copper strips 1 on a support (not visible). The composite is placed around the tubular member and either secured by adhesive or, if there is a neoprene layer present, the whole is vulcanised.

Figure 9:
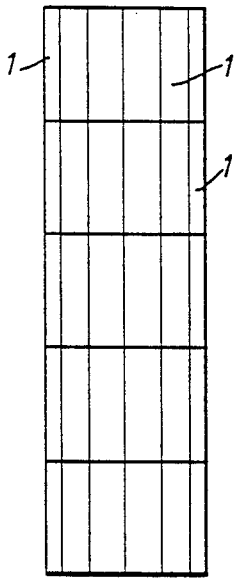
FIG. 9 is an elevation of a tubular member clad with another composite of the invention.

Instead of using a series of "collars" as shown in FIG. 8, the tubular member can be protected with a single layer composite as shown in FIG. 9. Here, the composite is a plurality of copper strips 1 across its width and along its length, the overall length of the composite equalling the length of the tubular member to be protected.

In FIGS. 1 to 4 we have illustrated elongate composites of the invention which are one copper strip wide. However, lengths of composite can be made of any width (and length) and can have the copper strips arranged side-by-side thereon in any conformation, provided that in use the desired result can be achieved, namely a substantially continuous non-buckled copper surface.

Figure 10:
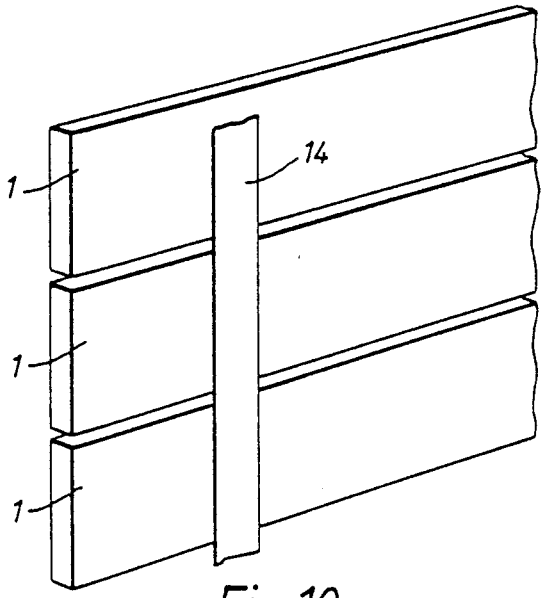
FIG. 10 is an elevation of the reverse side of another composite of the invention.

FIG. 10 shows another embodiment of composite of the invention in which the copper strips are temporarily secured together using one or more lengths of polyester tape 14 as the support on the face of the strips which will eventually be exposed. After securing the composite to the marine structure, the tape is removed.

I claim:

1. An elongate marine antifouling composite material for application over a polychloroprene protective coating on a marine structure to provide an antifouling surface thereon, said composite material comprising a plurality of individual strips of copper or a copper-nickel alloy and at least one elongated support means, said strips being mounted on said elongated support means so as to be closely spaced, generally parallel with one another and oriented generally transversely of said elongated support means, said elongated support means allowing said strips to move closer to each other when the composite material is applied over an uncured polychloroprene coating on a marine structure and the coating is then cured, the composite material thereby providing a substantially continuous copper or copper-nickel alloy surface on the marine structure.

2. An elongate composite material according to claim 1, wherein said strips are substantially parallelogram in shape.

3. An elongate composite material according to claim 1, wherein said support means is an open grid or mesh, or is one or more support members extending at an angle to a major axis of said strips.

4. A composite according to claim 1, wherein said support means is elastic so that when the composite material is applied, the support means is extended to provide for the close spacing between adjacent strips.

5. A composite according to claim 1, wherein said strips have bevelled edges so that when the composite material is applied to an uncured polychloroprene surface and the polychloroprene is thereafter cured, the volumetric contraction upon curing is accommodated by adjacent strips sliding with respect to each other at their bevelled edges to provide said continuous surface.

6. A method of providing a substantially continuous copper or copper-nickel alloy antifouling surface on a surface of a marine structure which comprises the steps of:

(i) coating the surface of the marine structure with uncured polychloroprene;

(ii) providing an elongate marine antifouling composite material comprising a plurality of individual strips of copper or a copper-nickel alloy and at least one elongated support means, said individual strips being mounted on the support means so as to be closely spaced, generally parallel with one another and oriented generally transversely of said elongated support means;

(iii) applying said composite material over the coated surface of said marine structure so as to lie on and be in contact with the polychloroprene; and (iv) curing the polychloroprene whereupon the polychloroprene coating shrinks and said strips move closer into contact with each other to provide a substantially continuous copper or copper-nickel alloy surface on the surface of the marine structure.

7. A method according to claim 6, wherein the marine structure is a tubular member, and wherein in step (ii) the elongate marine antifouling composite material is wound around the tubular member.

8. A method according to claim 7, wherein the elongate material composite is wound helically around a length of the tubular member, the strips of the composite material lying at an angle to the length of the composite material so that, as wound on the tubular member, the strips lie parallel to the axis of the tubular member, and after curing the polychloroprene layer, provides a substantially continuous copper or copper-nickel alloy surface thereon.

9. A method according to claim 6, wherein said elongated support means of the elongate composite material comprises a temporary elongate support on one face of the strips, and wherein the composite is applied to the coated surface with said one face of the strips outermost, and wherein the temporary support is then removed form said strips.

* * * * *